United States Patent [19]

Swenson

[11] 4,277,033

[45] Jul. 7, 1981

[54] WEB SUPPLY ARRANGEMENT

[76] Inventor: Robert E. Swenson, P.O. Box 688, Jeffersonville, Ind. 47130

[21] Appl. No.: 953,931

[22] Filed: Oct. 23, 1978

Related U.S. Application Data

[63] Continuation of Ser. No. 835,730, Sep. 22, 1977, abandoned, which is a continuation-in-part of Ser. No. 657,619, Feb. 12, 1976, abandoned.

[51] Int. Cl.[3] ..... B65H 17/02

[52] U.S. Cl. ..... 242/67.3 R; 40/515; 40/518

[58] Field of Search ..... 242/67.3 R, 67.1 R, 242/67.1 D, 71.3, 96, 99, 107.6; 40/514, 515, 518–523, 364–365; 281/7–9, 14; 188/82.77

[56] References Cited

U.S. PATENT DOCUMENTS

| | | | |
|---|---|---|---|
| 1,729,480 | 9/1929 | Hale | 40/515 |
| 2,588,803 | 3/1952 | Coffey | 40/364 |
| 3,003,271 | 10/1961 | Purling | 40/518 |
| 3,156,392 | 11/1964 | Johannes | 242/55.3 X |

*Primary Examiner*—John M. Jillions

[57] ABSTRACT

The present invention provides an arrangement for use in devices where a web of material, for example paper, is fed between a supply roll and a take-up roll to selectively, and/or consecutively, expose portions of the web. More particularly, in devices including web supply means and web take-up means where the web is fed from the supply to the take-up, the present invention provides an arrangement including web take-up spindle means to receive the web for take-up, journal means to receive at least one end of the take-up spindle where the journal has aperture means to rotatably receive one end of the web take-up spindle where the periphery of the aperture has at least one lobe opening therein and the spindle means includes radially flexible detent means to engage the periphery of the aperture of the journal means so the detent means can be urged radially inwardly by engagement with the periphery of the aperture and wherein the detent is urged radially outwardly to be received in the lobe opening of the aperture to restrict rotation of the spindle means in a selected direction, and guide means to guide the web from the web supply means to the take-up spindle means.

3 Claims, 8 Drawing Figures

WEB SUPPLY ARRANGEMENT

BACKGROUND OF THE INVENTION

The present application is a continuation of Application Ser. No. 835,730 filed Sept. 22, 1977 now abandoned, which is a continuation-in-part of Ser. No. 657,619, filed Feb. 12, 1976, now abandoned.

Various prior art means are known to selectively guide a printed web of material, for example paper, from a supply roll to a take-up role past a selected location for viewing or other purposes. Such arrangements have been found, for example, in roll calendars.

Such prior art devices have not, however, provided means to deal with problems common encountered due to the elasticity of the web. More particularly, the elasticity of the printed web, and the inherent web tension in such prior art arrangements prevent efficient and proper indexing of the selected segments of the web in the viewing or work area intermediate the supply and take-up spindles. Specifically, such prior art devices do not provide efficient and economical arrangements whereby the web can be indexed to the proper location because of the tension inherent in the web. As a result, the web either "backs-up" or "rolls forward" when the take-up spindle is rotated to index a portion of the web in the work area and multiple adjustments are necessary to finally secure proper indexing.

A few prior art devices have provided complex, expensive arrangements to prevent web "back-up" or "roll forward" but such devices are prohibitively expensive and furthermore, even the arrangements provided by such prior art devices are not entirely satisfactory.

SUMMARY OF THE INVENTION

The present invention provides a straightforward arrangement to provide a printed web of material, for example paper, from a web supply to a take-up roll and index the imprinted web at a selected work location intermediate the supply and take-up rolls.

The present invention further provides an arrangement where the supply roll and/or the take-up roll is journaled for rotation with means to restrain undesirable rotation of the spindles where an aperture is provided in the journal to receive the take-up roll spindle and wherein at least one lobe opening of selected depth is provided in the aperture, and the take-up spindle means is adapted to be received through the aperture and the take-up spindle means has a radially flexible detent which extends outwardly from the outer circumference of the spindle means to engage the periphery of the aperture means and is adapted to be urged radially outwardly to be received in the lobe opening means to restrain rotation of the spindle within the aperature.

The present invention further provides guide means to guide a web of material from the web supply means to the take-up spindle.

The present invention further provides a straightforward, extremely inexpensive arrangement which is particularly useful in the display of a roll calendar where the calendar role is imprinted with the days of the year consecutively along the length thereof so that each day of the year can be separately indexed for exposure through a viewing aperture which can be located in the work area described above.

Arrangements in accordance with the present invention further can provide means to fabricate a one-piece casing with a platten intermediate the web supply and web take-up rolls which can, advantageously, be utilized as a work surface, for example where the device is utilized as a children's coloring tray and where the web is imprinted with the outline of figures to be colored when the figures are indexed from the supply means to the platten.

Devices in accordance with the present invention overcome the prior art problem of "roll forward" or "roll back" by use of the advantageous journal arrangement for the take-up spindle and the restraint provided on rotation of the supply roll.

Moreover, the devices in accordance with the present invention are useful in any application wherein it is desired to consecutively index an imprinted web of material.

Various other features of the present invention will become obvious to those skilled in the art upon reading the disclosure set forth hereinafter.

BRIEF DESCRIPTION OF THE DRAWINGS

Referring now to FIG. 1, showing one arrangement in accordance with the present invention to receive and display, for example a calendar roll, a casing 1 is provided with a bottom 2, and spaced generally parallel cooperative sidewalls 3 and 4 located on eigher side of bottom 2. A front end wall 6, is provided having an aperture 7 defining a viewing slot as hereinafter described and a cooperative rear end wall 6A is provided to extend between sidewalls 3 and 4 to close a portion of the rear of the casing.

Guide means 8, 8A are cooperatively provided in walls 3 and 4 adjacent viewing slot 7 to receive a guide member 9 to guide a web, for example paper roll provided within the device in accordance with the present invention as described hereinafter and shown in FIG. 2.

Figure 2:
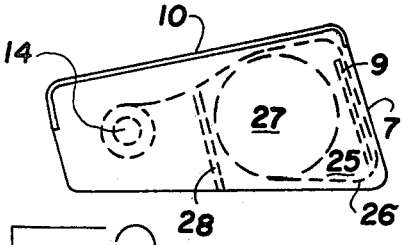
FIG. 2 is a view taken along line 2—2 of FIG. 1 with the device in assembled form.

Referring to FIG. 2, a top 10 is provided to enclose the top side of the casing defined by walls 3 and 4, as shown.

In accordance with one feature of the present invention, an aperture 12 is provided in sidewall 3 and an aperture 13 is provided in sidewall 4, in generally longitudinally aligned relation to receive a spindle member 14 adapted to take-up a web of material, for example a calendar roll, as hereinafter described and wherein apertures 13 and 14 rotatably journal spindle 14.

Figure 1:
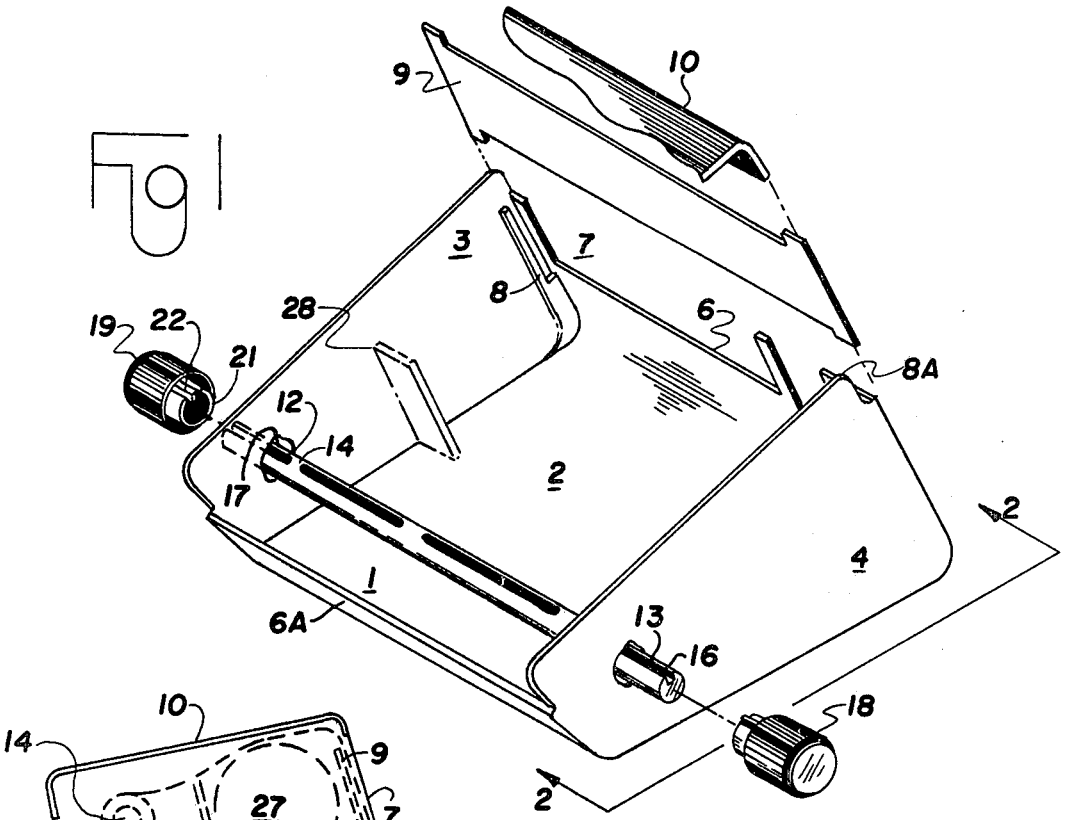
FIG. 1 is an exploded view of an arrangement in accordance with the present invention as applied to a calendar.

Partition means 28 (FIG. 2) can be provided within casing 1 to define a supply roll chamber 25 to receive web supply roll 27 where partition means 28 can extend all the way, or as shown in FIG. 1, only a part of the way between sidewalls 3 and 4. It will be recognized that other devices within the scope of the present invention may be adapted to utilize a journaled spindle in chamber 25 but the arrangement shown has also proved to be satisfactory.

Figure 3:
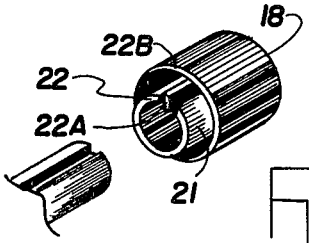
FIG. 3 is an exploded, enlarged view of one spindle arrangement as shown in the apparatus of FIG. 1.
Figure 4:
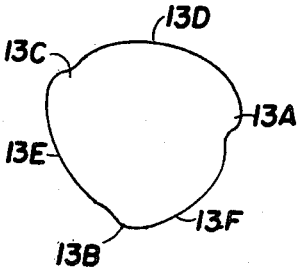
FIG. 4 is an outline of the periphery of an aperture provided in a sidewall of the arrangement as shown in FIG. 1.

Apertures 12 and 13 can advantageously be of the general shape shown in FIG. 4 wherein lobe openings 13A, 13B and 13C are provided around the periphery of the apertures to receive stop members hereinafter described and have a relatively steep outlet edge as well as a gradual transition section 13D–F. Lobe openings 13A–C and transition sections 13D–F disposed therebetween form a multiple lobed cam wheel wherein detent 22 (FIG. 3) acts as a follower as described hereinafter.

In accordance with the example of the present invention shown in FIGS. 1–4, spindle 14 is provided with longitudinally extending groove members 16 and 17 located adjacent opposite ends along a portion of the shaft member and are, advantageously, of selected width and depth as described hereinafter. In the example shown, cooperative knob means 18 and 19 are provided to be received on either end of spindle 14. In the example shown, each knob means 18, 19 can be made of plastic and can include an internal sleeve member 21 having a flexible, radially movable detent member 22 of selected depth and width. As shown in FIG. 3, the radial depth of detent member 22 can be greater than the thickness of the wall of sleeve 21 and detent 22, which is advantageously flexible for radial movement relative to the axis of sleeve 21, is disposed so that the lower portion 22A of detent member 22 extends inwardly past the periphery of the cylinder formed by sleeve 21.

The inwardly extending portion 22A of detent member 22 can, advantageously, be configured to be cooperatively received in slot member 16 of shaft 14 to prevent independent rotation of knob 18 on spindle 14 and can be radially movable, relative to sleeve 21, therein. Advantageously, the depth of slot member 16 can be greater than the depth of the portion 22A of detent 22 which extends below the inner periphery of sleeve 21, to allow radial movement of detent 22 into slot 16.

Likewise, it will be noted that a portion 22B of detent member 22 extends radially outwardly from the outer periphery of sleeve 21.

Referring now to FIG. 2, which shows the path of a web 26 through the apparatus shown in FIG. 1, web 26 is supplied from a supply roll 27 and web 26 is fed from supply roll 27 in a path beneath and in front of guide 9 to expose selected portions of the web to view through aperture 7. Supply roll 27 is retained in chamber 25 by separators 28 as previously described. Web 26 passes upwardly over the front side of guide 9 for exposure through aperture 7, then back over retainer 28 and to be wound on spindle 14, as shown. Retainers 28 can be provided on walls 3 and 4 between spindle 14 and supply roll 27 to retain supply roll 27 in position. It will be noted that in FIG. 2, top 10 is in position covering the top of casing 1.

Web 26 is advanced from supply roll 27 to spindle 14 by rotation of knob 18 connected to spindle 14.

In accordance with one feature of the present invention, detents 22 of knobs 18, are located in apertures 12 and 13 respectively. With respect to FIGS. 1 and 4, which illustrate the configuration of aperture 13 of sidewall 4, segment 22B of detent 22 engages the cam surface provided by aperture 13 where detent 22 can be in relaxed position when located in lobe openings 13A–C. As knob 18 is rotated in the direction indicated in FIG. 4, detent 22 engages ramp sections 13D, 13E or 13F, of aperture 13, whereby detent 22 is urged deeper into groove 16 and finally upon reaching the next lobe opening 13A–C, detent 22 is released into lobe opening 13A–C so that reverse rotation of detent 22 is precluded to prevent reverse rotation of knob 18 and spindle 14.

It will be recognized by the advantageous features of the cooperation between detent 22 and groove 16 of spindle 14, the segment of web 26 exposed to aperture 7 is securely located and recoil of web is prevented so that once a portion of web 26 is positioned in aperture 7, the drag inherent in the web flow path does not withdraw the particular segment from exposure to aperture 7.

Additionally, arrangements in accordance with the present invention provide means for maintaining tension in web 26 and preventing take-up spindle 14 from being reversed upon release after advancing web 26.

It will be further recognized that, depending upon the application of the invention, additional or fewer lobe openings can be provided in apertures 12 or 13 or the positions of the lobe openings can be staggered to provide more or less frequent locking of the take-up mechanism.

Figures 5, 6:
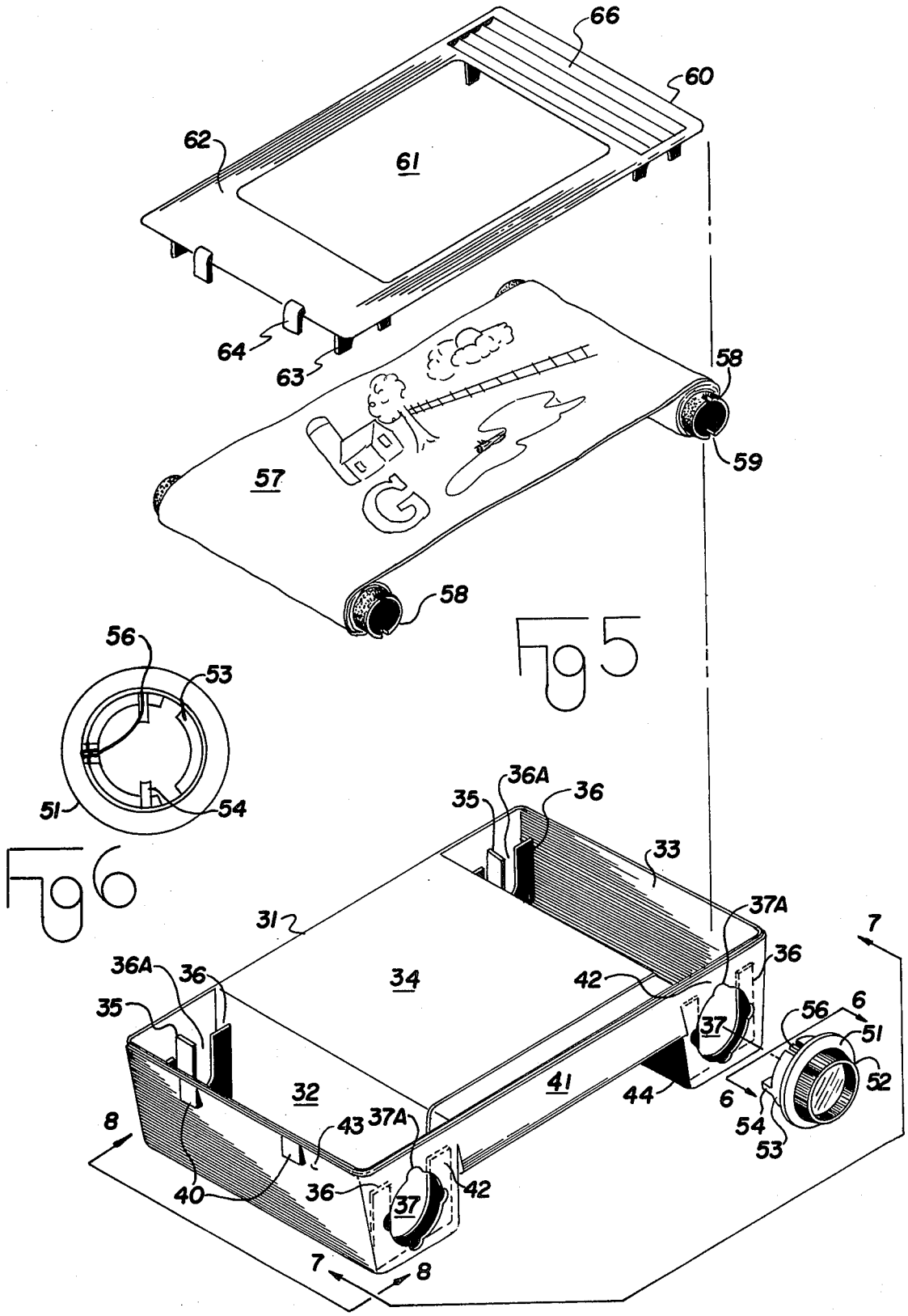
FIG. 5 is an exploded, perspective illustration of an arrangement in accordance with the present invention as a coloring device.
FIG. 6 is a view taken along a plane passing through line 6—6 of FIG. 5.

Referring now to FIG. 5, another application of the features of the present invention is illustrated with a work table, for example a device to store and feed a web of paper imprinted with figures to be colored by a child where a work area, as described hereinafter, is provided intermediate the web supply and take-up stations also described hereinafter.

The device includes a lower casing 31 having deep wells 32, 33 disposed at opposite ends of a work table 34. Spaced apertures 37 are provided in one sidewall with one aperture communicating with each of the wells 32, 33 as shown. In accordance with one feature of the present invention, lobe openings 37A are provided in the periphery of apertures 37.

A pair of saddle brackets 36 having openings 36A are also provided in spaced aligned relation in each well 32, 33, as shown where openings 36A in each well are in aligned relation with an aperture 37. Also, spacer means, for example, bars 35 can be provided in each well 32, 33 in aligned relation with openings 36A, at the sidewall opposite the respective openings 37, as shown.

Figure 7:
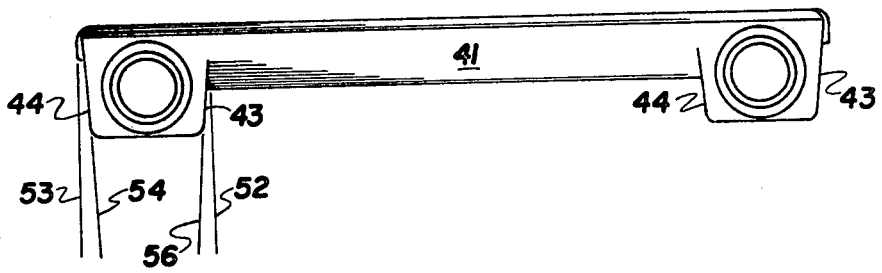
FIG. 7 is a view taken along a plane passing through line 7—7 of FIG. 5.

In accordance with one feature of the example of the present invention shown in FIG. 5 sidewalls 41, 42, 43 and 44 are adapted to facilitate release from a mold in which the casing is formed. For example, referring to FIGS. 7 and 8 which show side and end views of the assembled device, walls 43 and 44 are slanted inwardly from top to bottom as shown where lines 54, 56 are extensions of walls 43, 44 respectively as related to line 52, 53 which respectively represent a vertical reference.

Figure 8:
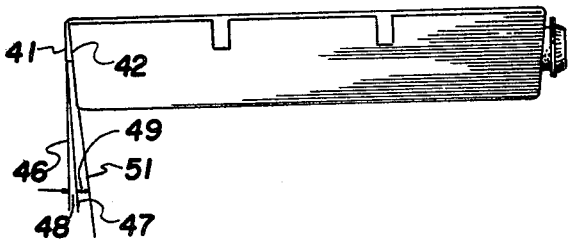
FIG. 8 is a view taken along a plane passing through line 8—8 of FIG. 5.

Likewise, referring to FIG. 8 which shows an end view of the device of FIG. 5, sidewall 42 of well 32 is inclined inwardly as indicated by line 51 which is an extension of wall 42 as compared with vertical reference 56. Likewise, web 41, which extends between wells 32, 33 under table 34 is inclined inwardly as shown by line 47 which is an extension of web 41 as compared with vertical reference line 46. It has been found that arrangements in accordance with the illustrations where the sidewalls of the base member 31 are inclined inwardly facilitate formation of the base where the internal walls of wells 32 and 33 and the corresponding well formed beneath table 34 and bounded by walls 41 have outwardly sloped walls so that the mold die can be easily released after forming and the base can be easily released from the mold cavity.

Lugs 40 are provided at each end of the casing 31 to secure a lid, as described hereinafter.

It will be recognized that the foregoing is but one example of an arrangement in accordance with the present invention and various other arrangements, within the scope of the present invention, will occur to those skilled in the art upon reading the disclosure set forth hereinbefore.

I claim:

1. A web supply and take-up arrangement including:

(a) a web supply roll means to provide a supply of selected web;

(b) a rotatable web take-up means to receive web supplied from said web supply roll means including elongate web take-up spindle means of selected diameter having at least one longitudinally extending groove means of selected depth located adjacent at least one first end of said spindle means, and wherein said web is would onto a portion of said spindle means adjacent said groove means upon rotation of said spindle means;

(c) flexible radially outwardly biased detent means disposed for rotation with said spindle means and normally located radially outwardly from said groove means and spaced aligned relation therewith whereby said detent means is capable of being selectively urged into said groove means;

(d) journal means including cooperative aperture means to rotatably receive said first end of said spindle means, wherein said aperture means has a diameter larger than the diameter of said spindle and a portion of the periphery of said aperture means engages said detent means to urge said detent means into said groove means, saidaperture means periphery further includes outwardly extending lobe opening means for receiving said detent means to restrict rotation of said spindle means; and (e) web guide means to guide said web from said web supply means to said web take-up means.

2. The invention of claim 1 wherein said web take-up spindle means includes knob means having a collar means for receiving said first end of said spindle means, and wherein said collar means includes base to carry said radially outwardly biased detent means, and wherein said aperture means receives said collar means to hold said detent means in said groove means until said knob means is rotated to a position where said detent is released into said lobe opening means.

3. The invention of claim 1 wherein said aperture means includes at least one cam surface of decreasing radius to contact said detent means of said spindle means to urge said detent means into said groove means as said spindle means is rotated in a first direction, and wherein said cam surface terminates at said lobe opening means whereby said detent means springs radially outwardly with respect to said spindle means so that said detent means engages said lobe opening means to restrict rotation of said spindle means in a direction of rotation opposite to said first direction.

* * * * *